US011134325B2

(12) United States Patent
Hrudey et al.

(10) Patent No.: US 11,134,325 B2
(45) Date of Patent: Sep. 28, 2021

(54) LIDS WITH A PATTERNED CONDUCTOR FOR MICROPHONE TRANSDUCER PACKAGES, AND ASSOCIATED MODULES AND DEVICES

(71) Applicant: Apple Inc., Cupertino, CA (US)

(72) Inventors: Peter C. Hrudey, Cupertino, CA (US); Anthony D. Minervini, Sunnyvale, CA (US); Joseph R. Maurer, San Jose, CA (US)

(73) Assignee: Apple Inc., Cupertino, CA (US)

( * ) Notice: Subject to any disclaimer, the term of this patent is extended or adjusted under 35 U.S.C. 154(b) by 177 days.

(21) Appl. No.: 16/450,808

(22) Filed: Jun. 24, 2019

(65) Prior Publication Data

US 2020/0404407 A1 Dec. 24, 2020

(51) Int. Cl.

| | |
|---|---|
| ***H04R 1/00*** | (2006.01) |
| ***H04R 1/08*** | (2006.01) |
| ***H04R 1/06*** | (2006.01) |

(52) U.S. Cl.

CPC ..... *H04R 1/083* (2013.01); *H04R 1/06* (2013.01); *H04R 2201/025* (2013.01)

(58) Field of Classification Search

CPC . H04R 1/04; H04R 1/06; H04R 1/083; H04R 19/04; H04R 19/005; H04R 2201/003; H04R 2201/025; H04R 31/006

See application file for complete search history.

(56) References Cited

U.S. PATENT DOCUMENTS

| | | | | |
|---|---|---|---|---|
| 9,852,844 | B2 | 12/2017 | Golko et al. | |
| 2002/0188345 | A1 | 12/2002 | Pacetti | |
| 2008/0262628 | A1 | 10/2008 | Laitenberger et al. | |
| 2014/0117473 | A1* | 5/2014 | Kierse | H01L 29/84 257/416 |
| 2018/0302727 | A1 | 10/2018 | Deas | |

FOREIGN PATENT DOCUMENTS

| | | |
|---|---|---|
| DE | 29919872 | 9/2000 |
| GB | 25261403 | 10/2018 |
| WO | 2018189547 | 10/2018 |

OTHER PUBLICATIONS

Fu, Fangwei, "Transient Eddy Current Response Due to a Subsurface Crack," Doctoral Dissertation, 2006, 169 pages, Iowa State University.

John F. McClelland, et al., "Capacitive MEMS Microphone Optimized Research," Apr. 18, 2005, 20 pages.

* cited by examiner

*Primary Examiner* — Matthew A Eason

(74) *Attorney, Agent, or Firm* — Morgan, Lewis & Bockius LLP

(57) ABSTRACT

A microphone assembly has an interconnect substrate and a microphone transducer coupled with the substrate. A lid overlies the microphone transducer. At least a portion of the lid is spaced from the substrate, defining an acoustic chamber for the microphone transducer. The lid can have a layer of discretized metal or other patterned conductor. The discretized layer of metal or other patterned conductor is configured to inhibit formation of eddy currents, as when exposed to electromagnetic radiation. The lid can be grounded. Microphone modules and electronic devices also are described.

17 Claims, 10 Drawing Sheets

LIDS WITH A PATTERNED CONDUCTOR FOR MICROPHONE TRANSDUCER PACKAGES, AND ASSOCIATED MODULES AND DEVICES

FIELD

This application and related subject matter (collectively referred to as the "disclosure") generally concern packaged microphone transducers, as well as modules and electronic devices, and other systems, incorporating such microphone transducers.

BACKGROUND INFORMATION

In general, sound (sometimes also referred to as an acoustic signal) constitutes a vibration that propagates through a carrier medium, such as, for example, a gas, a liquid, or a solid. An electro-acoustic transducer, in turn, is a device configured to convert an incoming acoustic signal to an electrical signal, or vice-versa. Thus, an acoustic transducer in the form of a microphone can be configured to convert an incoming acoustic signal to an electrical (or other) signal.

An acoustic diaphragm of a microphone transducer, e.g., a MEMs microphone transducer, can vibrate, move, or otherwise respond to a pressure variation induced by a vibration and received through a surrounding or adjacent carrier medium. Movement of the diaphragm can induce a corresponding response in an electrical component. For example, movement of a diaphragm in a capacitive MEMs microphone can alter a capacitance of the device, inducing an observable, time-varying voltage signal in an electrical circuit. As another example, movement of a piezoelectric MEMS diaphragm can generate a time-varying electrical signal by virtue of a piezoelectric response to the movement. A time-varying electrical response generated with either type of microphone transducer can be converted to a machine-readable form (e.g., digitized) for subsequent processing.

SUMMARY

This paper describes a variety of packages, e.g., for microphone transducers (or other components). Some disclosed packages have a lid that incorporates a patterned conductor configured to restrict, reduce, or otherwise inhibit formation of eddy currents within or on the lid when the lid is exposed to an electromagnetic field. Such packages can be combined into an electronic device, and the lid can be electrically coupled with a device ground, providing shielding to components encased by the lid against electromagnetic interference.

According to a first aspect, a microphone assembly has an interconnect substrate, and a microphone transducer coupled with the substrate. A lid overlies the microphone transducer. At least a portion of the lid is spaced from the substrate, defining an acoustic chamber for the microphone transducer. The lid includes a stratum of conductive material configured to inhibit formation of eddy currents within the stratum of conductive material when the lid is exposed to electromagnetic radiation.

The lid can have a non-conductive substrate, and the stratum of conductive material can be a conformal coating overlying the non-conductive substrate.

The stratum of conductive material can include a plurality of discrete members, and each respective member can be electrically coupled with at least one corresponding electrical connection, e.g., in the package. In some embodiments, each discrete member is electrically isolated from each other discrete member. In some embodiments, the at least one corresponding electrical connection is a common ground pad, and each discrete member is electrically coupled with the common ground pad.

The stratum of conductive material can be a unitary construct defining a plurality of apertures. And, the lid can include a non-conductive substrate defining a protrusion extending through at least one of the apertures. In some embodiments, the protrusion extends through each respective aperture.

The interconnect substrate can define a ground plane, and the stratum of conductive material can be electrically coupled with the ground plane, defining a Faraday cage around the acoustic chamber.

According to another aspect, a microphone module includes an interconnect substrate having a plurality of electrical conductors. A microphone package has a package substrate, a microphone transducer and a processing device coupled with the package substrate. A lid defines a chamber at least partially enclosing the microphone transducer and the processing device. The chamber is bounded in part by the package substrate. The package substrate electrically couples the microphone transducer, the processing device, or both, with at least one of the interconnect substrate's electrical conductors. The lid includes a patterned conductor configured to inhibit formation of eddy currents within the patterned conductor when the patterned conductor is exposed to electromagnetic radiation.

The lid can include a molded and electrically insulative member coupled with the patterned conductor. The patterned conductor can include one or more of a metal mesh, a stamped metal plate and a metal plating. In some embodiments, the patterned conductor includes a plurality of electrically conductive members.

In an embodiment, the lid also includes a molded and electrically insulative member defining a boss. The patterned conductor can define an aperture positioned in correspondence to the boss. In some embodiments, the patterned conductor can include an electrically conductive member defining an aperture so arranged as to inhibit formation of eddy currents within the electrically conductive member when the electrically conductive member is exposed to an electromagnetic field. The aperture can be so positioned in the patterned conductor as to inhibit formation of eddy currents within the patterned conductor when the patterned conductor is exposed to an electromagnetic field. The patterned conductor can include an electrically conductive member defining a plurality of apertures so arranged as to inhibit formation of eddy currents within the electrically conductive member when the electrically conductive member is exposed to an electromagnetic field.

In some embodiments, the package substrate has a ground plane and the patterned conductor can be electrically coupled with the ground plane. The patterned conductor can include a plurality of electrically conductive members. Each electrically conductive member can be electrically coupled with the ground plane independently of each other electrically conductive member.

According to another aspect, an electronic device includes a processor, a memory, and an interconnect bus. The device also includes a microphone package having a package substrate, a microphone transducer, a processing device coupled with microphone transducer and the package substrate. A lid defines a chamber at least partially enclosing the microphone transducer and the processing device. The interconnect bus operatively couples the processing device with the processor and the memory. The lid includes a patterned conductor configured to inhibit formation of eddy currents within the patterned conductor when the patterned conductor is exposed to electromagnetic radiation.

In some embodiments, the lid also includes a molded and electrically non-conductive member coupled with the patterned conductor.

The interconnect bus can include a ground connection. The package substrate can include a ground plane electrically coupled with the ground connection. The patterned conductor can be electrically coupled with the ground plane, electrically coupling the patterned conductor with the ground connection of the interconnect bus.

The foregoing and other features and advantages will become more apparent from the following detailed description, which proceeds with reference to the accompanying drawings.

BRIEF DESCRIPTION OF THE DRAWINGS

Referring to the drawings, wherein like numerals refer to like parts throughout the several views and this specification, aspects of presently disclosed principles are illustrated by way of example, and not by way of limitation.

In FIG. 6A, the patterned conductor has a plurality of conductors, each having a corresponding ground contact, as shown in the section view in FIG. 6B.

DETAILED DESCRIPTION

The following describes various principles related to packages for MEMs components, e.g., for microphone transducers, as well as modules and electronic devices incorporating such components. For example, some disclosed principles pertain to inhibiting electrical currents (e.g., so-called eddy currents) that can arise in a component package exposed to an electromagnetic field. Further, some disclosed principles pertain to component packages that incorporate features configured to inhibit eddy currents.

To illustrate disclosed principles, several embodiments of microphone packages are described. That said, descriptions herein of specific package, component, electronic device, or system configurations, and specific combinations of method acts, are just particular examples of contemplated package, component, electronic device, and system configurations, and method combinations, chosen as being convenient to illustrate disclosed principles. One or more of the disclosed principles can be incorporated in various other configurations and combinations to achieve any of a variety of corresponding, desired characteristics. Thus, a person of ordinary skill in the art, following a review of this disclosure, will appreciate that configurations and combinations having attributes that are different from those specific examples discussed herein can embody one or more presently disclosed principles, and can be used in applications not described herein in detail. Such alternative embodiments also fall within the scope of this disclosure.

I. Overview

Figure 1A:
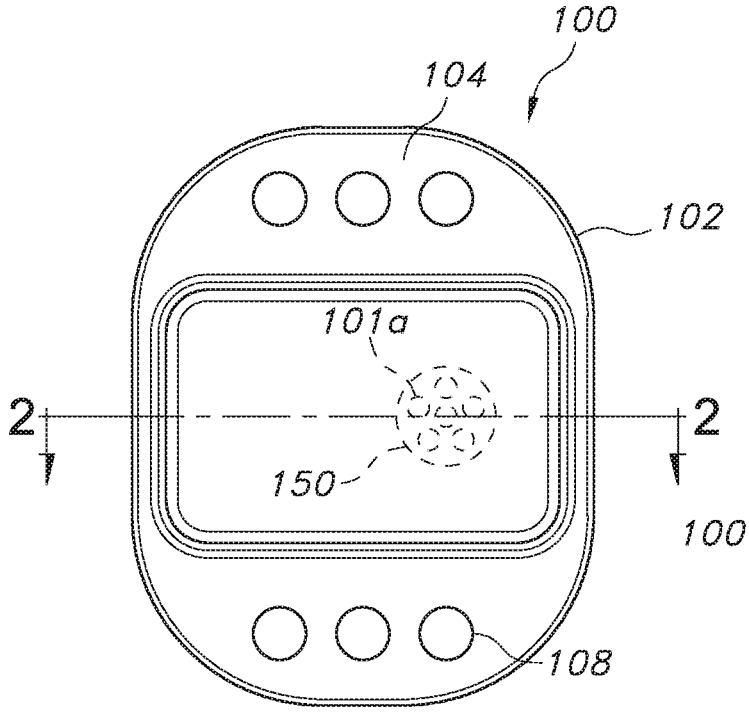
FIG. 1A illustrates a plan view from above a microphone assembly.
Figure 1C:
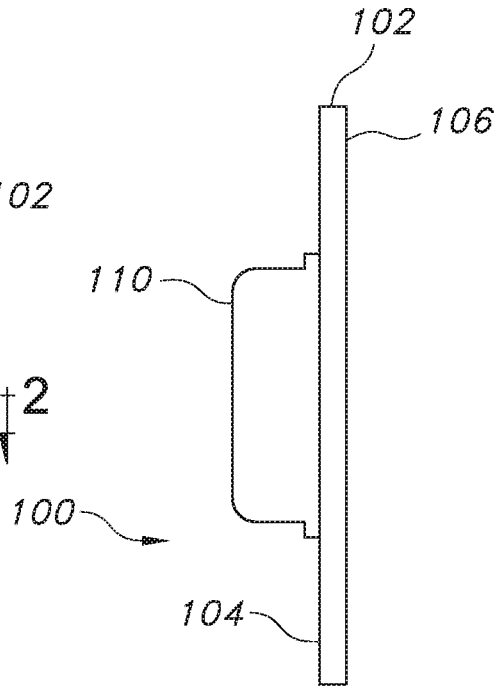
FIG. 1C illustrates a side-elevation view of the assembly in FIG. 1A.
Figure 1B:
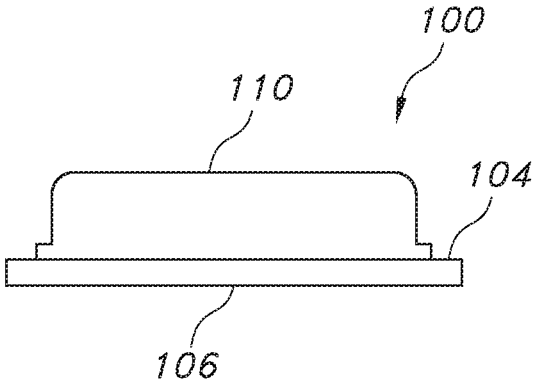
FIG. 1B illustrates an end-elevation view of the assembly in FIG. 1A.

As shown in FIGS. 1A through 1C, a package 100 for a MEMs component, e.g., a microphone transducer, can have a substrate 102 defining a first major surface 104 and an opposed second major surface 106. The illustrated substrate 102 defines at least one aperture 101*a* extending through the substrate from the first major surface 104 to the second major surface 106, defining a sound-entry region 150 of the substrate 102 through which sound from outside the package 100 can enter.

Figure 2:
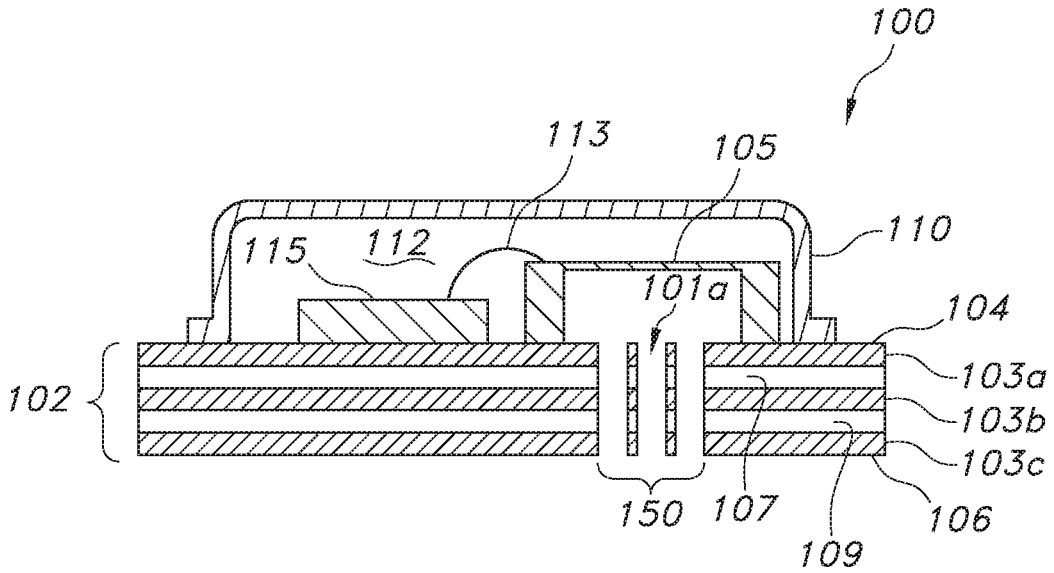
FIG. 2 illustrates a cross-sectional view of the assembly in FIG. 1A taken along section line 2-2.

As the cross-sectional view in FIG. 2 shows, a microphone transducer 105 can be mountably coupled with the interconnect substrate 102 (also referred to as substrate 102 and package substrate 102) on the first major surface 104. The microphone transducer 105 has a sound-responsive diaphragm (not shown) acoustically coupled with the sound-entry region 150 defined by the substrate 102, permitting sound to enter a front volume of the microphone transducer. In FIG. 2, the microphone package 100 houses a processing device 115 (e.g., an application-specific integrated circuit, or ASIC) mounted to the package substrate 102. A bond wire 113 electrically couples the integrated circuit device with the acoustic transducer element 105.

In FIG. 2, a lid 110 overlies the microphone transducer 105 and the processing device 115. The lid 110 can be mounted to the substrate 102. At least a portion of the lid 110 can be spaced apart from the substrate, defining an acoustic chamber 112 for the microphone 105. As described below, the lid 110 can be grounded as to inhibit electromagnetic interference, a potential source of noise in observed sound by the microphone. For example, although not shown in FIG. 2, the substrate 102 can have a connection to ground and the lid 110 can be electrically coupled with the substrate's connection to ground.

As fluid, e.g., air, in the acoustic chamber 112 changes temperature (e.g., is heated), pressure in the chamber can correspondingly change. A sensitive region of the microphone transducer 105 can deform as pressure in the chamber 112 changes. Such deflection can induce the transducer 105 to emit a signal, e.g., noise, corresponding to the temperature of the chamber 112, rather than, for example, incoming sound. Consequently, temperature variations in the acoustic chamber can introduce further noise into observed sound.

An alternating or other time-varying electromagnetic field can heat the lid 110. Although many sources of such electro-magnetic fields exist, one possible source can be a cellular or wireless multiplexing signal. Generally speaking, an alternating or other time-varying electromagnetic field can induce eddy currents on a surface of a metal object or other electrical conductor as a result of Faraday's law of induction. Such currents tend to heat the electrical conductor via the so-called Joule heating effect. Accordingly, eddy currents induced on a lid 110 will tend to heat the lid, which in turn can heat the acoustic chamber 112. As noted above, a change in temperature of a gas in the acoustic chamber 112 can introduce noise into sound observations by the microphone 105.

Some lid and package embodiments described herein can inhibit the formation of eddy currents, their heating effects, or both. For example, the magnitude of an eddy current in a given loop can correspond to an area of the loop. Some lid embodiments restrict an area over which eddy currents can flow, reducing the magnitude of the eddy current and thus reducing Joule heating of the lid. For example, an electrically conductive region of the lid 110 can be discontinuous in a plane (e.g., as seen in FIG. 1A from above), which can restrict an area available for eddy currents to form.

In some embodiments, a lid can include a patterned conductor configured to inhibit formation of eddy currents. A configuration of the patterned conductor can be selected to inhibit or eliminate heating of the acoustic chamber, reducing so-called thermal noise. In some lids, the patterned conductor can include one or more of a metal mesh, a stamped metal plate and a metal plating (e.g., a conformal metal coating applied to a substrate), providing a conductive structure that is non-continuous in at least one direction. Such discontinuous structures can have anisotropic conductivity, e.g., to interrupt eddy current formation in the patterned conductor.

Some patterned conductors incorporate non-metallic conductors. For example, a patterned conductor may be a composite mixture of conductive portions (e.g., Cu, Ag, Au) and non-conductive portions (e.g., SiO2). The non-conductive portions may also or alternatively include one or more iron oxides having high magnetic permeability. Nonetheless, the net result of such a mixture can still result in an electrically conductive member that can be patterned. In some embodiments, the patterned conductor can be segmented, defining a plurality of discrete conductors. For example, a lid can include a plurality of electrically conductive members, each of which can be configured to inhibit or prevent formation of eddy currents.

As also described more fully below, some lid embodiments include a material having a relatively high heat capacity. Lids having a high heat capacity can damp temperature fluctuations that otherwise could arise from transient heating of the lid. Such transient heating can occur from time-varying eddy currents.

II. Microphone Packages

Referring again to FIG. 2, the microphone transducer 105 can be mounted on or otherwise be operatively coupled with a package-level substrate 102. The substrate can include electrical conductors to interconnect power, ground, and/or signal connections between the processing device 115 and another device external to the package 100. The microphone package 100 can also include a lid 107 overlying the acoustic transducer 105. The lid 107 can be recessed, defining a chamber, or back volume 112, for the transducer 105.

The illustrated package substrate 102 defines a sound entry region 150. The sound-entry region 150 may be defined by a single aperture or may be defined by a plurality of apertures 101*a* defining a perforated region of the substrate 102. In either arrangement, the sound entry region 150 is acoustically, and in many instances fluidly, coupled with a sound-responsive element (not shown) of the microphone transducer 105. An unoccupied, open chamber bounded by the substrate 102 and the sensitive region of the microphone transducer 105 is sometimes referred to in the art as a "front volume."

Each aperture 101*a* defining a sound-entry region 150 through the substrate 102 can be a non-plated through via having a diameter measuring between about 50 μm and about 200 μm, such as, for example, between about 75 μm and about 150 μm, e.g., between about 90 μm and about 110 μm. The sound-entry region 150 can have a characteristic dimension, e.g., a hydraulic diameter in selected embodiments, measuring between about 1.000 mm and about 3.000 mm, such as, for example, between about 1.200 mm and about 2.400 mm, e.g., between about 1.4 mm and about 2.2 mm. Naturally, other configurations and dimensions for a sound-entry region 150 are possible. The dimensions listed above have been chosen as being representative of one particular configuration of the many configurations contemplated by this disclosure.

For a capacitive MEMS microphone, the processing device 115 (FIG. 2) can include circuitry to impose a charge on a sound-responsive element (not shown) of the microphone 105, and as a diaphragm (not shown) deforms, the processing device can observe changes in voltage arising from the deformation (e.g., changes in capacitance). For a piezoelectric MEMS microphone, the processing device 115 can observe voltage or electrical currents arising from deflection of a piezoelectric member due to impinging sound waves. In either type of MEMS transducer, the voltage or current variations can correspond to sound waves that induce the deflections in the diaphragm.

The package substrate 102 can have an electrical output connection (not shown) coupled with the integrated circuit device 115. As well, the package substrate 102 can have an electrical trace or other electrical coupler that extends from the contact to another region defined by the substrate (e.g., a second, external electrical contact). For example, the package substrate can have a plurality of conductive layers juxtaposed with a plurality of non-conductive layers. As shown in FIG. 2, the substrate 102 can have opposed outer non-conductive layers 103*a*, 103*c*, and first and second conductive layers 107, 109, which can define power, ground and signal paths, separated from each other by an inner non-conductive layer 103*b*. One or more conductive vias (not shown) can extend through one or more of the non-conductive layers 103*a*, 103*b*, 103*c*, defining an electrical connection that can electrically couple the processing device 115 with the layer 107, the layer 109, or both. Similarly, the substrate 102 can define another electrical connection that is electrically coupled with the layer 107, the layer 109, or both, and configured to electrically couple with an external circuit. Consequently, the package substrate 102 can electrically couple an external portion of an electrical circuit or device with the processing device 115, the microphone transducer 105, or both.

Microphone packages as described herein can be mounted on or otherwise be operatively coupled with another substrate, e.g., an interconnect substrate of a microphone module or an electronic device. For example, the package 100 can be mounted to and electrically coupled with an interconnect substrate. Such assemblies are described further below in relation to, for example, FIGS. 7 and 8.

III. Lid with Patterned Core

Figure 3A:
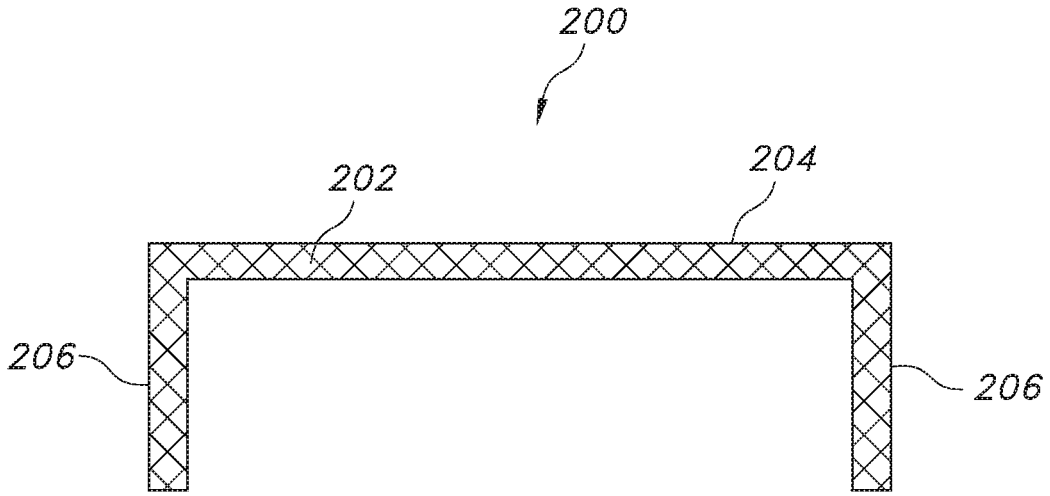
FIG. 3A illustrates a cross-sectional view of a patterned core of a lid for microphone package as in FIG. 2.

A lid for a MEMS component package 100 can incorporate a patterned conductor configured to inhibit or to prevent formation of eddy currents in the lid. For example, FIG. 3A illustrates a patterned core 200 formed using an electrically conductive mesh 202. In FIG. 3A, a wire mesh 202 is formed into a structure having a generally planar top region 204 and downwardly extending side walls 206.

An electrically conductive mesh 202 can be constructed, for example, by weaving or knitting strands of electrically conductive material with each other to define a mesh panel, or other unitary construct. The mesh panel, in turn, can be formed or otherwise processed into a recessed configuration as depicted in FIG. 3A.

As an example, strands of metal wire (e.g., an alloy of stainless steel, such as, for example, SS316) can be woven or knit into a mesh panel (not shown). Each strand of metal wire can have a diameter of between about 15 μm and about 75 μm, for example, between about 10 μm and about 90 μm.

Additionally, a spacing between, for example, warp strands and weft strands used to construct the mesh 202 can be selected to provide a desired wire pitch or aperture size through the mesh. For example, warp strands and weft strands, each having a diameter of 50 μm and a pitch of 150 μm, can provide roughly square mesh apertures through the mesh 202 measuring about 100 μm on each side. Such a mesh defines a conductive structure that is non-continuous in at least one direction. For example, the apertures defined between the warp and weft strands provide the mesh with anisotropic conductivity, which can interrupt eddy current formation.

The size of the apertures, and thus the strand diameter and pitch, can be selected according to a frequency range of electromagnetic radiation anticipated to impinge on the microphone package 100. For example, the mesh can be grounded to define a Faraday cage around the processing device 115 and microphone transducer 105, and a permissible size of aperture through the mesh can correspond to a desired range of frequencies that the Faraday cage is intended to shield against.

Optionally, the strands of conductive material can be plated by a metal alloy, such as, for example, a copper, silver, or gold alloy. The plating can have a thickness between about 1 μm and about 10 μm, e.g., between about 0.8 μm and about 8 μm. The plating can be applied to the strands before or during a weaving or a knitting process used to construct the mesh panel. Alternatively, the plating can be applied to the mesh 202 before, during, or after processing into the arrangement depicted in FIG. 3A. If a mesh as described above (e.g., 50-μm-diameter warp strands and weft strands, each having a 150 μm pitch) is plated evenly with a 10-μm-thick layer of copper (or other material), a finished wire diameter could be about 90 μm, and the apertures through the mesh could measure about 80 μm per side.

A patterned core 200 as shown in FIG. 3A can be over-molded by an electrically non-conductive material. For example, the mesh 202 can be part of an insert in an insert-molded part. Stated differently, a plastic or other non-conductive material can be molded over or otherwise made to cover the mesh 202.

Figure 3B:
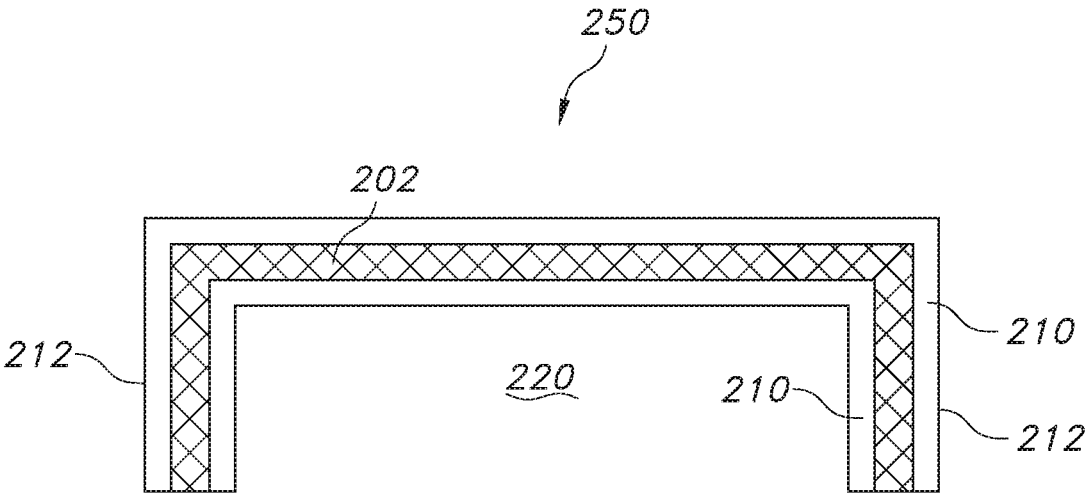
FIG. 3B illustrates a cross-sectional view of an intermediate construct for a lid of a microphone package. The intermediate construct has patterned core shown in FIG. 3A with an over-molded substrate.

FIG. 3B, for example, shows an intermediate construct 250 having a patterned core 200 as just described embedded within an over-molded, electrically insulative material 210. The downwardly extending side walls 206 in FIG. 3B can define a recessed interior region 220 that can receive, for example, a microphone transducer 105 and processing device 115, as shown in FIG. 2.

A variety of polymeric materials can have a suitably low electrical conductance to electrically insulate the mesh 202. Material properties that could be considered in addition to electrical resistivity or conductance can include mechanical stiffness, ductility, and heat capacity. Material properties of polymers can be selectively manipulated by dispersing particles of a filler material throughout the polymer matrix. Such particles can have a characteristic dimension on an order of one nanometer to an order of tens of micrometers. Examples of filler materials include silicon dioxide, aluminum oxide, barium titanate and aluminum nitride, though other filler materials can be used to attain desired properties of the over-molded material.

Figure 3C:
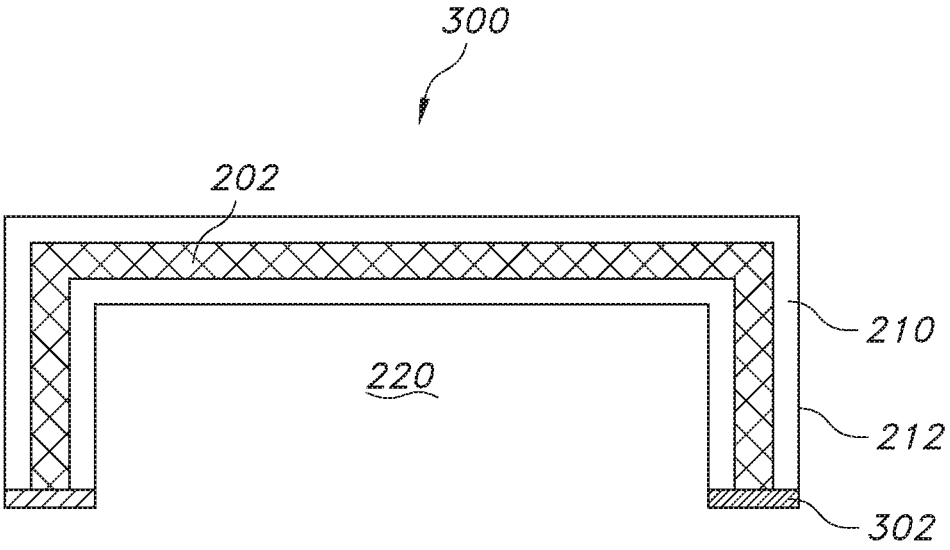
FIG. 3C illustrates a lid of a microphone package. The lid includes a conductive pad at the base of the intermediate construct shown in FIG. 3B.

FIG. 3C schematically illustrates a metal plating or other conductive pad 302 applied to a lower surface of the lid 300 and electrically coupled with the patterned core 202. The conductive pad can be a metal layer deposited on a lower edge of a side wall 212. The conductive pad 302 provides the patterned core 202 with an electrical connection suitable to electrically couple the core 202 with an external electrical conductor.

For example, the conductive pad 302 can electrically couple with an electrical contact defined by the substrate 102. The pad 302 can be soldered to a corresponding electrical contact defined by the substrate 102. In another embodiment, the pad 302 can be electrically coupled with the substrate through an electrically conductive adhesive or an electrically conductive epoxy. In an embodiment, the conductive pad 302 electrically couples the patterned core 202 with a ground connection could with a ground plane in the substrate 102.

Patterned cores as described in relation to FIGS. 3A through 3C can reduce an area available to eddy currents, inhibiting their formation and thus reducing the Joule heating effect caused by eddy currents within the lid 300. In addition, any heating that may occur can be absorbed by the over-molded material, which can serve as a transient heat sink and can damp transient temperature changes.

Further, a patterned core 202 can define a continuous structure, e.g., a mesh panel, or the patterned core can be segmented or otherwise discretized, further reducing area available for formation of eddy currents. In an embodiment, the patterned core 202 can include a plurality of discrete, electrically conductive members (e.g., mesh segments) that are electrically isolated from each other within the lid 300, as by an intervening, non-conductive compound. For example, a plurality of mesh members can be insert molded within a polymer. The mesh members can be physically spaced apart from each other to prevent contact with each other. The polymer can be injection molded and can fill a gap between adjacent mesh members, electrically isolating the members from each other within the lid 300.

Discrete members of a patterned conductor are described by way of example in relation to FIGS. 6A through 6D, below. Further, a mesh member can define one or more enlarged apertures, as by removing (e.g., by cutting or etching away) an interior region of a mesh panel, generally as described below in relation to FIGS. 5A through 5E. Principles described with reference to those drawings can be applied to the patterned core in the lid 300 shown in FIG. 3C.

As above, a non-conductive material can fill the enlarged apertures or regions between discrete members, defining protrusions extending therethrough and ensuring that the mesh core 202 is segmented, restricting, reducing, or otherwise inhibiting formation of eddy currents when exposed to electromagnetic fields.

IV. Stratified Lid with Conductive and Non-Conductive Strata

As noted above, a lid for a MEMS component package 100 can incorporate a patterned conductor configured to inhibit or to prevent formation of eddy currents in the lid. In some embodiments, a lid can incorporate one or more strata having a patterned conductor juxtaposed with one or more strata of non-conductive material. Lid embodiments having an embedded patterned core, as described above, are specific examples of lids having a stratum of a patterned conductor. Other embodiments of stratified lids also are possible.

Figure 4:
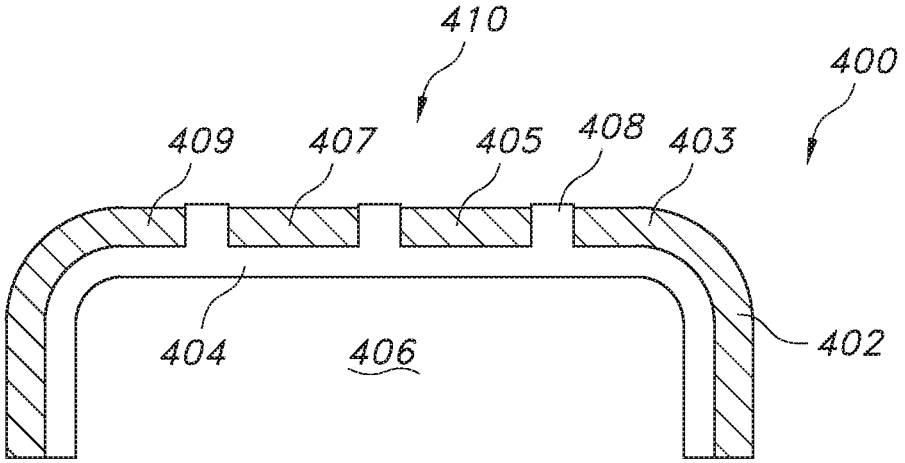
FIG. 4 illustrates a cross-sectional view of an alternative embodiment for a package lid having a patterned conductor.

For example, FIG. 4 illustrates a cross-section of another embodiment of a stratified lid having an exposed stratum of a patterned conductor juxtaposed with a partially exposed and partially covered non-conductive stratum. More specifically, the lid 400 shown in FIG. 4 has a stratum of molded plastic 404 and a stratum of patterned conductor 402 overlying the stratum of molded plastic. In FIG. 4, the stratum of molded plastic 404 generally defines an interior recess 406 similar in configuration to the recess 220 in FIG. 3C that can define an acoustic chamber, e.g., acoustic chamber 112 shown in FIG. 2. The molded plastic 404 in FIG. 4 defines one or more protrusions 408 or bosses extending outwardly in a direction away from the recess 406. As FIG. 4 shows, the outwardly extending protrusions 408 can interrupt the overlying stratum of metal 402, defining a conductive structure that is non-continuous in at least one direction and providing the stratum with a desired configuration, e.g., as to restrict formation of eddy currents, similarly to the internal protrusions of non-conductive material described above as filling enlarged apertures in a patterned core. As with the apertures defined between the warp and weft strands in FIG. 3A, the protrusions that interrupt the stratum 402 can provide the stratum with anisotropic conductivity, which can interrupt eddy current formation. Although metal is indicated in relation to FIG. 4, other conductive, non-metallic materials are contemplated.

In an embodiment, a stratum of a patterned conductor can include a conformal coating or plating of electrically conductive material applied to a substrate, frame, or other carrier constructed, for example, from an electrically non-conductive material. In some embodiments, a stratum of a patterned conductor can include, for example, an electrically conductive plate insert molded into or onto an electrically non-conductive material. Further, such coatings, platings, inserts, and plates can be segmented, discretized or otherwise patterned through a subsequent subtractive, formative, or additive manufacturing process. For example, a coating, a plating, an insert, and a plate can be machined, laser etched, chemically etched to segment, to discretize, or otherwise to pattern the coating, plating, insert or plate.

Referring still to FIG. 4, the stratum of patterned conductor 402 can be produced using any of a variety of manufacturing techniques (e.g., one or more of a forming process, an additive process, and a subtractive process). A forming process, such as, for example, an insert-molding process, can be used to provide one or more regions 403, 405, 407, 409 of the stratum of patterned conductor 402. In an insert-molding process, one or more pieces of a conductive material (such as, for example, a metal plate) is inserted into a mold cavity before an injected material hardens or cures. The conductive material can be inserted in the mold before the non-conductive material is injected into the mold or after the non-conductive material is injected but before it hardens or cures. As noted above, e.g., in relation to FIG. 3B, the conductive material forming the stratum of conductive material can be segmented or otherwise discretized, defining the one or more regions 403, 405, 407, 409 of the stratum of patterned conductor 402.

The stratum of patterned conductor 402 can be produced using an additive manufacturing process. For example, a stratum of non-conductive material 404 can be produced using any suitable process (e.g., one or more of a forming process, an additive process, and a subtractive process). A plating- or other additive-process can selectively deposit a conductive material on one or more regions of an outer surface of the non-conductive material 404. The outwardly extending protrusions 408 can aid in the plating- or other additive-process by defining a physical boundary, or stop, that limits or restricts an extent to which the conductive material overlies or flows over the non-conductive material, e.g., until the conductive material hardens or cures. The additively produced stratum of conductive material can undergo one or more subsequent processes to achieve a desired final pattern. For example, the non-conductive material can undergo a mechanical, a chemical, an optical, or a combination process.

Further, the stratum of patterned conductor 402 can be produced using a subtractive manufacturing process. For example, a desired configuration of the conductive stratum 402 can be achieved by direct laser etching, micromachining and/or chemical etching to selectively remove conductive material from desired regions. The resulting workpiece can be assembled (e.g., adhered, insert molded, snap-fit, or otherwise joined) with the non-conductive substrate 404 to produce a finished lid 400, as shown for example in FIG. 4.

In general, a stratum of patterned conductor 402 as described above can have any configuration that suitably restricts, reduces or otherwise inhibits formation of eddy currents. In some embodiments, the patterned conductor 402 can be configured to direct an eddy current away from an interior region 410 of the lid, e.g., as to reduce heating of the interior region of the lid and by extension an acoustic chamber (or microphone back volume). In some embodiments, the patterned conductor 402 can be configured to direct heat away from the interior volume 406 of the lid, again to reduce heating of the interior region of the lid and by extension an acoustic chamber (for microphone back volume).

FIGS. 5A through 5E schematically illustrate several examples of a configuration for a patterned conductor overlying a partially exposed and partially covered non-conductive stratum. In each configuration shown in FIGS. 5A through 5E, the corresponding patterned conductor has at least one discontinuity, providing the patterned conductor, and thus the corresponding lid, with anisotropic conductivity. Such anisotropic conductivity can inhibit formation of eddy currents within the conductor.

Figure 5A:
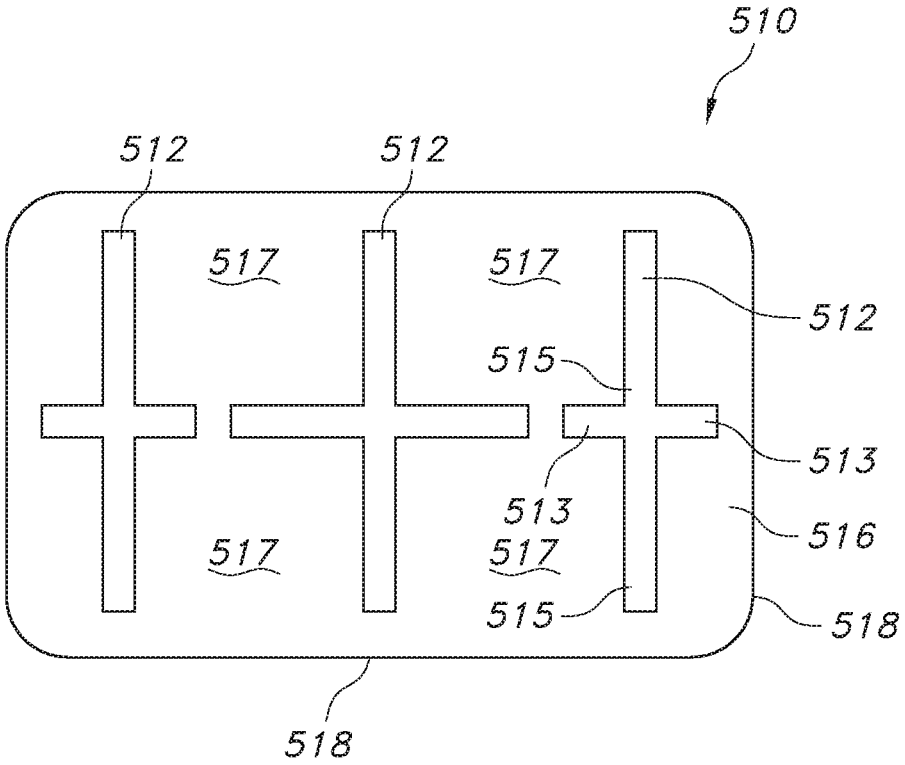
FIGS. 5A through 5D illustrate respective plan views from above alternative embodiments of a package lid having a patterned conductor.

In FIG. 5A, a plan view from above a lid 510 having protrusions 512 (similar to protrusions 408 in FIG. 4) of non-conductive material shows a plurality of cross-like structures. Each cross-like structure has a plurality of discrete, intersecting and transversely arranged arms 513, 515 of non-conductive material extending laterally outward of a central region 514. The discrete arms 513, 515 interrupt the stratum of conductive material 516, defining a corresponding plurality of regions 517 "flooded" with conductive material. In FIG. 5A, none of the arms intersect with a peripheral edge 518 of the lid. However, as with the ribs 522 shown in FIG. 5B, some embodiments of cross-like structures can have one or more arms 513, 515 reach and intersect with a peripheral edge. As shown, each region 517 can have a substantially smaller area compared to an overall area of the lid 510. By defining the several regions 517, the protrusions 512 restrict, reduce or otherwise inhibit formation of eddy currents within the stratum of conductive material. As well, by providing a direct path along the conductive stratum from an interior region to an outer periphery 518 of the lid 510, the patterned conductor 516 is configured to direct an eddy current away from the interior region and to direct heat away from the interior region. As shown in FIG. 5A, the finished stratum of conductive material can be a unitary construct defining a plurality of apertures through which the non-conductive material extends.

Figure 5B:
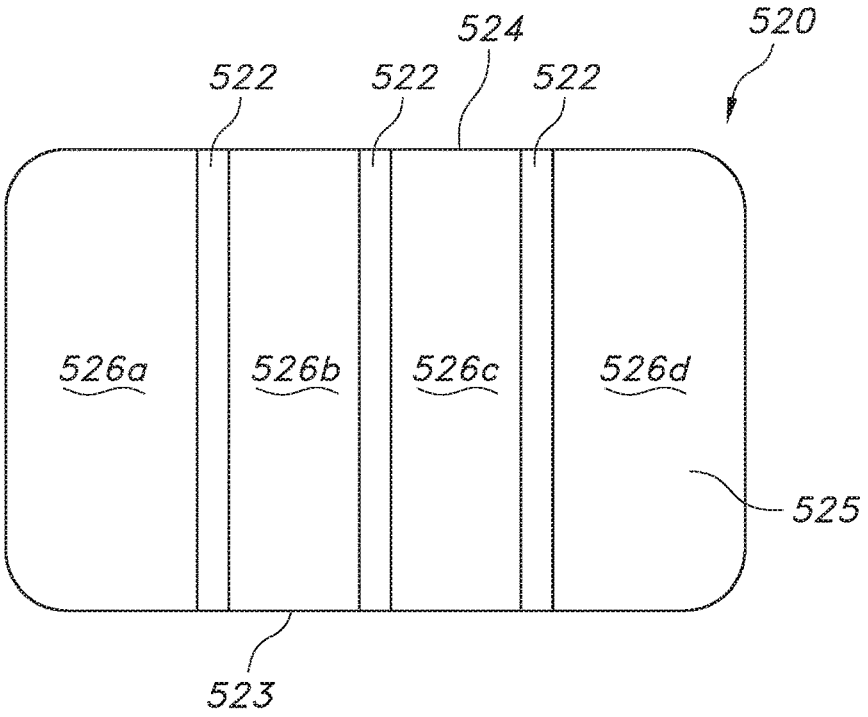

In FIG. 5B, a plan view from above a lid 520 having protrusions (similar to protrusions 408 in FIG. 4) of non-conductive material configured as a plurality of linear ribs 522. In this example, each rib 522 of non-conductive material extends across the lid 520 from one peripheral edge 523 to an opposed peripheral edge 524. In other embodiments, such ribs can extend partially across the lid, e.g., without intersecting a peripheral edge, just as the cross-like structures in FIG. 5A do not intersect the peripheral edge. The ribs 522 interrupt the stratum of conductive material, defining a corresponding plurality of regions 526*a*, 526*b*, 526*c*, 526*d* "flooded" with conductive material. As shown, each region 526*a*, 526*b*, 526*c*, 526*d* can have a substantially smaller area compared to an overall area of the lid 520. By defining the several regions of conductive material 526*a*, 526*b*, 526*c*, 526*d*, the ribs 522 restrict, reduce or otherwise inhibit formation of eddy currents within the stratum of conductive material. As well, by providing a direct path along the conductive stratum from an interior region to an outer periphery 523, 524 of the lid 520, the patterned conductor 525 is configured to direct an eddy current away from the interior region and to direct heat away from the interior region. As shown in FIG. 5B, the finished stratum of conductive material can include a plurality of discrete members, or at least discrete regions. As described more fully below, each respective region or member can be electrically coupled with at least one corresponding electrical connection (e.g., a ground pad). In some embodiments having discrete members, each discrete member can be electrically isolated from each other discrete member.

Figure 5C:
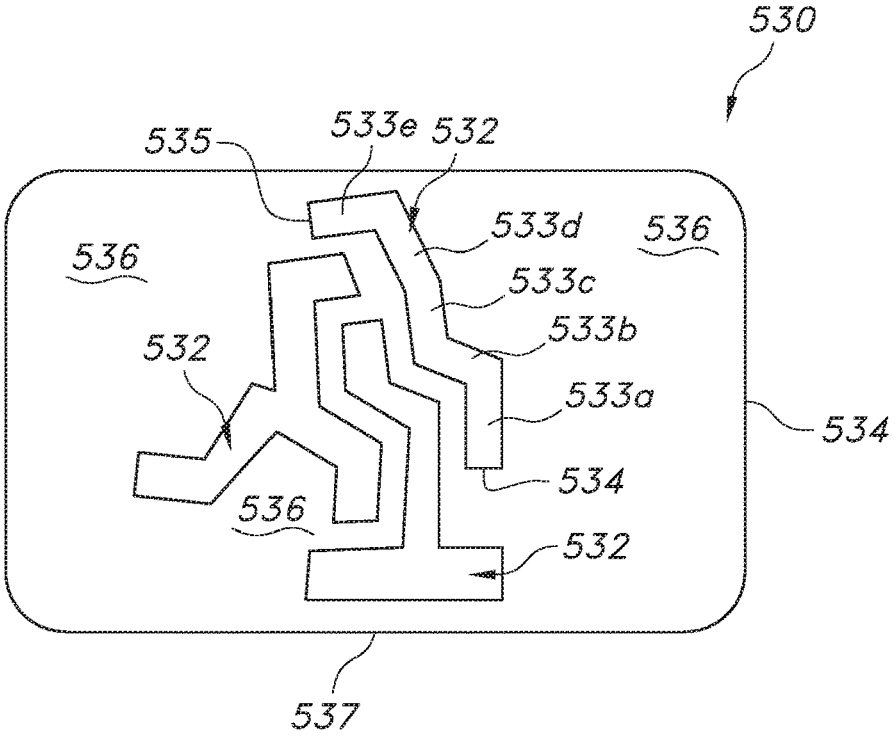

In FIG. 5C, a plan view from above a lid 530 shows a plurality of "interlocking" ribs 532 of non-conductive material interrupting the stratum 534 of conductive material. In this example, each rib 532 of non-conductive material extends longitudinally along a crooked path having a plurality of individual segments, e.g., segments 533*a*, 533*b*, 533*c*, 533*d*, 533*e* joined together end-to-end. Each segment can be straight or curved along a longitudinal axis of a given rib 522. In some embodiments, a non-linear rib can extend longitudinally from a first end 534 to a second end 535 and have a continuous curvature, as opposed to the non-continuous curvature depicted in FIG. 5C that lends each rib a "crooked" configuration. As well, a width dimension of a given rib (i.e., measured transverse relative to the longitudinal axis of a given rib or segment thereof) can vary with longitudinal position along the respective rib. As in embodiments above, a non-linear rib can extend partially across the lid, e.g., without intersecting a peripheral edge, or a non-linear rib can intersect one or more peripheral edges. The ribs 532 in FIG. 5C interrupt the stratum of conductive material, defining a corresponding plurality of regions 534 "flooded" with conductive material. As shown, each region 536 can have a substantially smaller area compared to an overall area of the lid 530. By defining the several regions of conductive material, the ribs 522 restrict, reduce or otherwise inhibit formation of eddy currents within the stratum of conductive material. As well, by providing a direct path along the conductive stratum from an interior region to an outer periphery 537 of the lid 530, the patterned conductor 534 is configured to direct an eddy current away from the interior region and to direct heat away from the interior region.

Figure 5D:
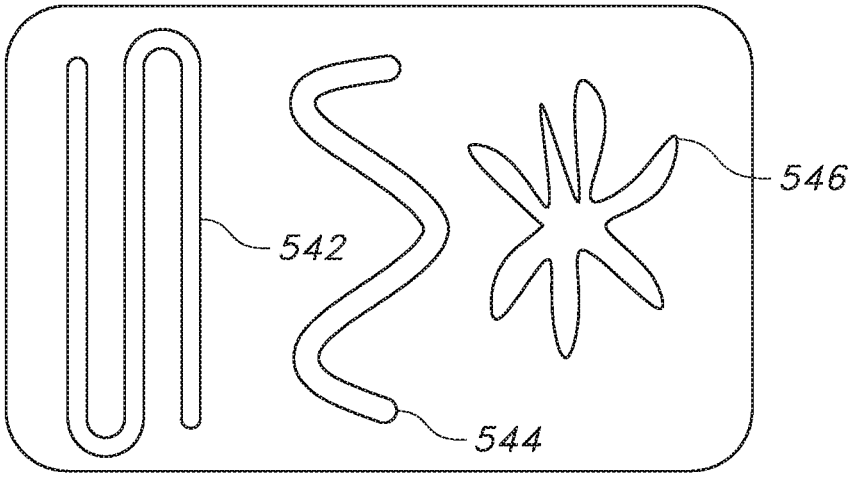

Generally, any configuration of a protrusion 408 (FIG. 4) that interrupts a stratum of conductive material 402 sufficiently to restrict, reduce or otherwise inhibit formation of eddy currents within the stratum of conductive material can be used in a microphone lid. FIG. 5D illustrates other representative examples such protrusions. As FIG. 5D shows, the protrusions can be convoluted 542, sinuous 544, or have any selected number of branches defined by intersecting, transverse arms extending laterally outward within a plane of the lid, as with the protrusion 546.

Figure 5E:
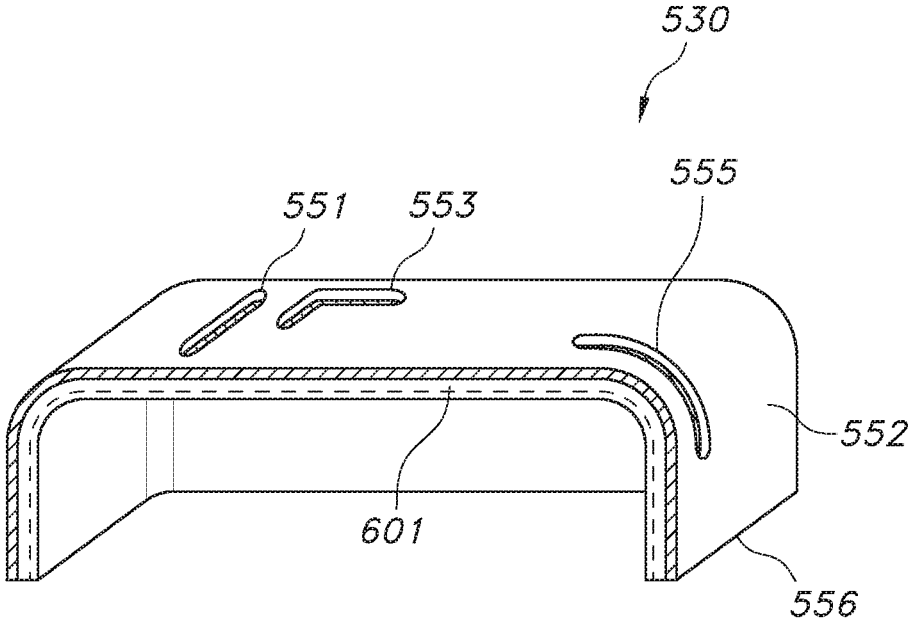
FIG. 5E shows an isometric view of a sectioned microphone lid having a patterned conductor.

FIG. 5E illustrates an isometric view of a cross-section through a microphone lid 550 having a stratum 552 of conductive material overlying a stratum 554 of non-conductive material. In FIG. 5E, a plurality of regions 551, 553, 555 of the conductive stratum have been removed (e.g., by laser or chemical etching, or micromachining), revealing the underlying stratum of non-condcutive material, e.g., without having any protrusions as in FIG. 4. As with the protrusions shown in FIGS. 4 and 5A through 5D that interrupt the respective strata of conductive material, the regions 551, 553, 555 (e.g., slots, channels, etc.) devoid of conductive material in FIG. 5E can restrict, reduce or otherwise inhibit formation of eddy currents within the stratum 552 of conductive material. As well, by providing a direct path along the conductive stratum from an interior region to an outer periphery 556 of the lid 550, the patterned conductor 552 is configured to direct an eddy current away from the interior region and to direct heat away from the interior region. Although the regions 551, 553, 555 shown in FIG. 5E are bounded within the stratum 552 by conductive material, other regions of material can be removed from the stratum 552 adjacent to or intersecting with a periphery 556 of the lid 550. In some embodiments, the stratum 552 can be segmented to define discrete regions of conductive material that are electrically isolated from each other. As described more fully below, each respective region can be electrically coupled with at least one corresponding electrical connection (e.g., a ground pad). In some embodiments having discrete regions, each discrete member can be electrically isolated from each other discrete member.

A variety of polymeric materials can be suitable for the non-conductive strata shown among FIGS. 4 and 5A through 5E. Material properties that could be considered during selection of the non-conductive material, in addition to electrical resistivity or conductance, can include mechanical stiffness, ductility, and heat capacity. Material properties of polymers can be selectively manipulated by dispersing particles of a filler material throughout the polymer matrix. Such particles can have a characteristic dimension on an order of one nanometer to an order of tens of micrometers. Examples of filler materials include silicon dioxide, aluminum oxide, barium titanate and aluminum nitride, though other filler materials can be used to attain desired properties of the over-molded material.

Patterned, conductive strata as described in relation to FIGS. 4 and 5A through 5E can reduce an area available to eddy currents, inhibiting their formation and thus reducing the Joule heating effect caused by eddy currents within the corresponding lid. In addition, any heating that may occur can be absorbed by the corresponding non-conductive strata, which can serve as a transient heat sink and can damp transient temperature changes.

V. Lids Providing Ground Contact

Figure 6A:
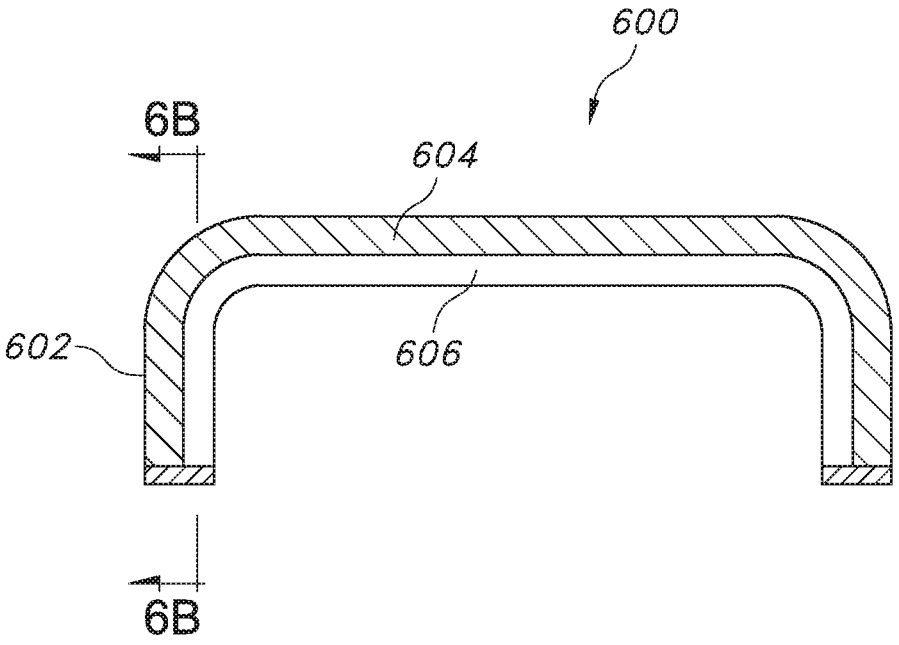
FIG. 6A illustrates a cross-sectional view of an alternative embodiment for a package lid having a patterned conductor.
Figure 6B:
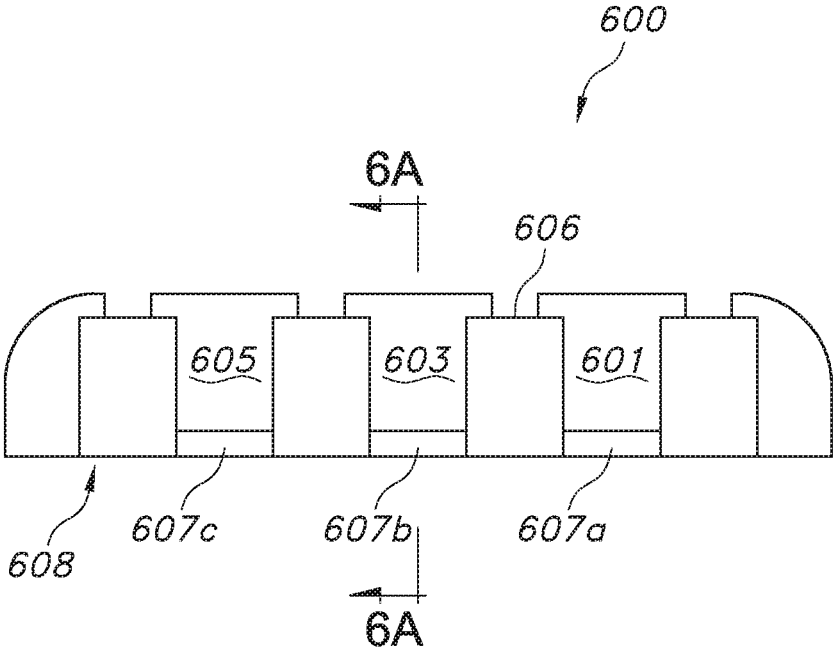
FIG. 6B illustrates a cross-sectional view taken along line 6B-6B through a sidewall of the lid shown in FIG. 6A, revealing a plurality of ground paths within the lid.

Lids incorporating patterned, conductive strata, as described in relation to FIGS. 4 and 5A through 5E, can include a metal plating or other conductive pad applied to a lower surface, e.g., a lower edge, of the lid. FIG. 6A illustrates a portion of a lid 600 in cross-sectional view similar to FIG. 4. FIG. 6B shows a cross-sectional view of a side-wall 602 of the lid 600 taken along section line 6B-6B, revealing juxtaposed portions of the lid's conductive stratum 604 and non-conductive stratum 606. In FIG. 6B, the lid's conductive stratum 604 is shown as being segmented. In each configuration shown in FIGS. 6A and 6B, the corresponding patterned conductor has at least one discontinuity, providing the patterned conductor, and thus the corresponding lid, with anisotropic conductivity. As noted above, such anisotropic conductivity can inhibit formation of eddy currents within the conductor. A common ground connection can span across the discrete segments 601, 603, 605, and the common ground pad can electrically couple with a corresponding electrical connection defined by a package substrate 102 (FIG. 2).

Figure 6C:
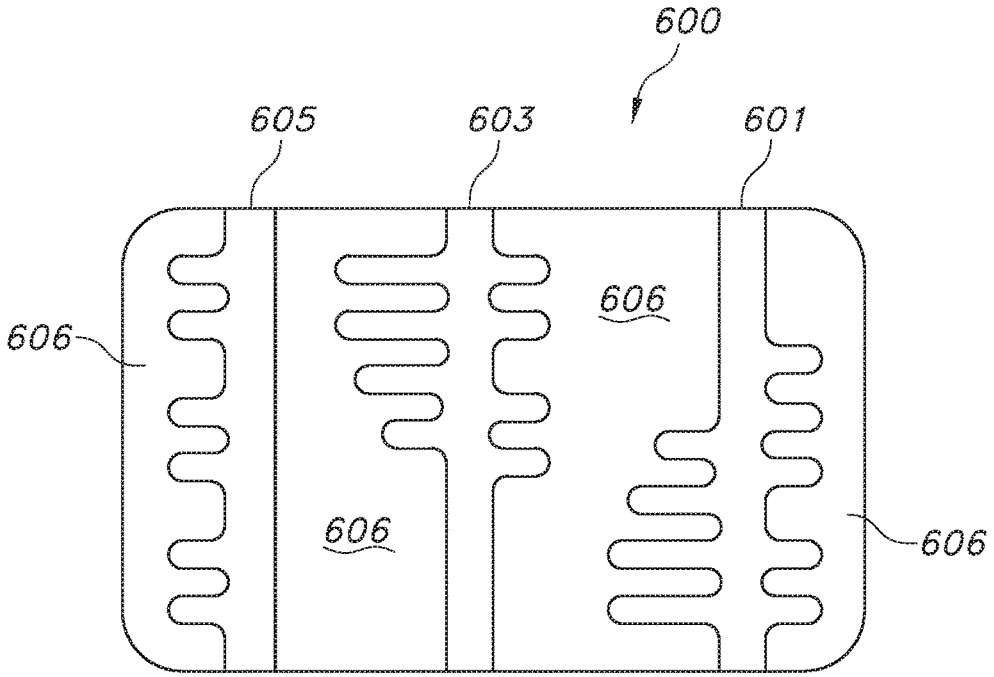
FIG. 6C illustrates a plan view from above a lid having a plurality of discrete conductors, each being electrically coupled with a corresponding ground pad within the lid, defining a plurality of corresponding ground paths within the lid.

In other embodiments, each respective segment 601, 603, 605 has a corresponding conductive pad 607*a*, 607*b*, 607*c*, electrically coupling the pad with the stratum 604 of conductive material, and more particularly, with each respective segment 601, 603, 605 thereof. Each conductive pad 607*a*, 607*b*, 607*c* can be a metal layer selectively deposited along a lower edge 608 of the side wall 602. Each conductive pad 607*a*, 607*b*, 607*c* can provide each corresponding segment of the conductive stratum 604 with an electrical connection suitable to electrically couple the stratum with an external electrical conductor. FIG. 6C illustrates a top-plan view of the lid 600 showing the segmented stratum 604 of conductive material, e.g., segments 601, 603, 605.

In FIG. 6C, each segment 601, 603, 605 is patterned as to restrict, reduce, or otherwise inhibit eddy currents within the respective segment. For example, each segment defines opposed first and second edges, one or both of which (or neither of which) may be fluted. Such flutings can further inhibit formation of eddy currents within a respective one of the segments. As shown by the segment 605, one of the edges can be fluted and the opposed edge can have a different, e.g., straight, contour. Segment 603 and segment 601 define fluted opposed edges. However, the adjacent segments 601 and 603 define flutings that are offset from the flutings of the adjacent segment. In another embodiment, flutings of one edge of a given segment can be offset from flutings of the opposed edge of that given segment.

Figure 6D:
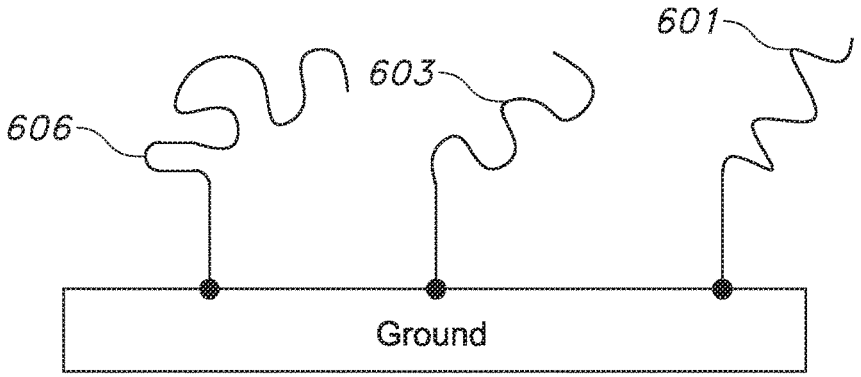
FIG. 6D illustrates a schematic diagram of a plurality of discrete ground paths within a lid, e.g., a lid as shown in FIG. 6C.

Referring again to FIG. 6B, each conductive pad 607*a*, 607*b*, 607*c* can electrically couple with an electrical contact defined by the substrate 102 (FIG. 2). For example, a given pad 607*a*, 607*b*, 607*c* can be soldered to a corresponding electrical contact defined by the substrate 102. In another embodiment, the given pad 607*a*, 607*b*, 607*c* can be electrically coupled with the substrate through an electrically conductive adhesive or an electrically conductive epoxy. In an embodiment, each conductive pad 607*a*, 607*b*, 607*c* electrically couples the corresponding segment of the conductive stratum 601, 603, 605 with a ground plane in the substrate 102 independently of each other segment's connection to the ground plane. Accordingly, when the conductive stratum 604 is segmented and each segment is electrically isolated from each other segment, the conductive pads can allow each segment to be grounded independently of each other segment. FIG. 6D schematically illustrates the independent grounding of each segment of the conductive stratum shown in FIGS. 6B and 6C, defining a Faraday cage around the acoustic chamber. Such independent grounding, in turn, can restrict, reduce, or otherwise can inhibit formation of eddy current loops within the segmented stratum and among the segments thereof.

VI. Microphone Modules

Figure 7:
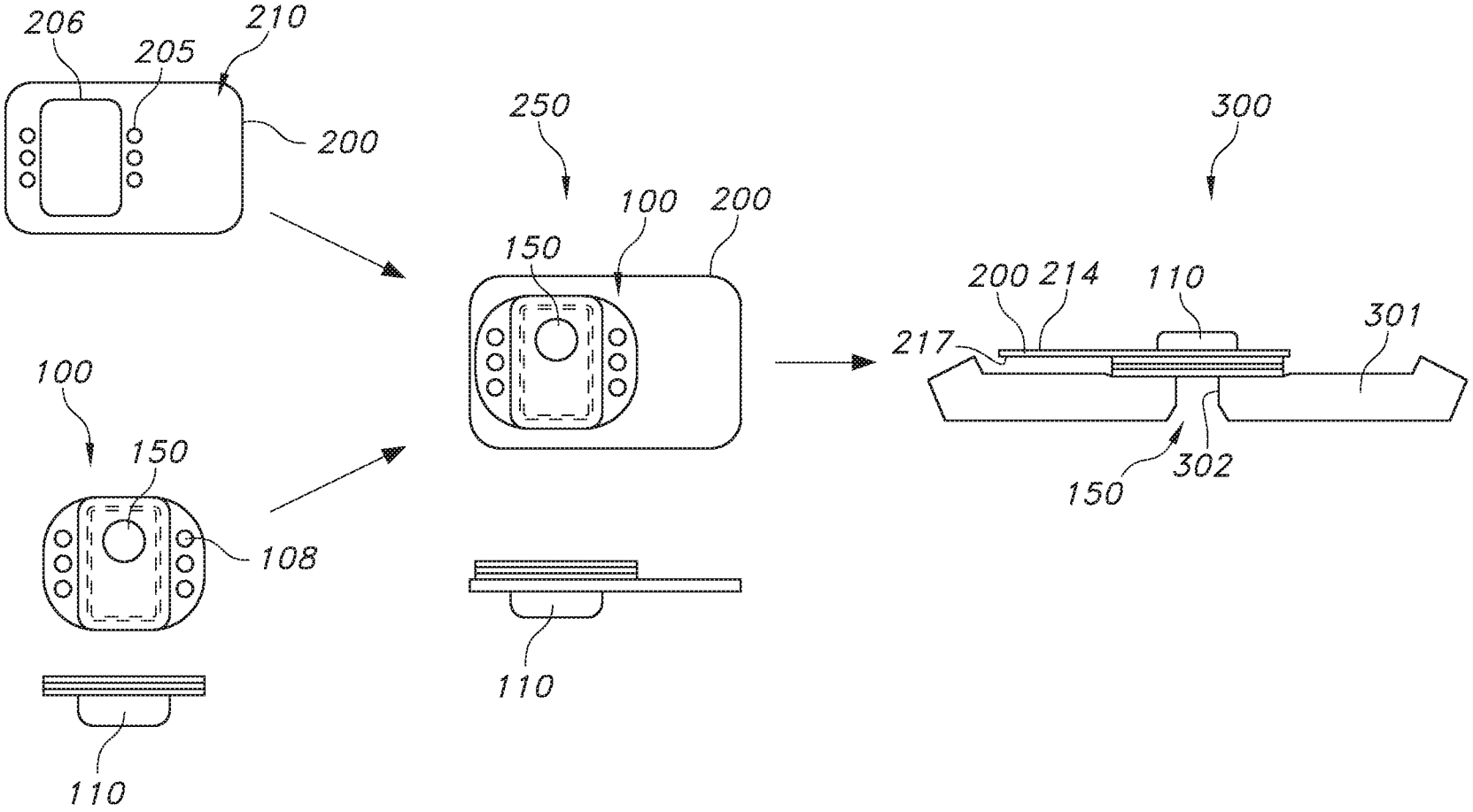
FIG. 7 illustrates a microphone-transducer package assembled as part of a microphone module in an electronic device.

Referring now to FIG. 7, a microphone assembly 100 of the type described herein can be incorporated in a microphone module 250. For instance, the microphone module 250 can include a microphone transducer 105 (FIG. 2) having a sound-responsive sensitive region. The sound-responsive sensitive region of the microphone transducer 105 can be acoustically coupled with an external ambient environment through the substrate 102, and more particularly through the sound-entry region 150. The microphone transducer 105 may include, for example, a micro-electro-mechanical system (MEMS) microphone. It is contemplated, however, that microphone transducer can be any type of electro-acoustic transducer operable to convert sound into an electrical output signal, such as, for example, a piezoelectric microphone, a dynamic microphone or an electret microphone. The microphone transducer 105 can be enclosed under a lid 110 having a patterned conductor configured to restrict, reduce, or otherwise inhibit formation of eddy currents within the lid. The lid 110 (e.g., a segment of a patterned conductor) can be grounded with a ground plane within the package substrate 102.

A microphone module 250, in turn, can include an interconnect substrate 200. As shown in FIG. 7, the package 100 can be electrically coupled with a complementarily arranged interconnect substrate 200. In general, an interconnect substrate 200 can include a plurality of electrical conductors configured to convey an electrical signal, or a power or a ground signal, from one interconnection location (e.g., a solder pad) 205 to another interconnection location (e.g., another solder pad). For example, a packaged component, e.g., the microphone package 100, can be soldered or otherwise electrically coupled with one or more interconnection locations defined by an interconnect substrate 200.

The interconnect substrate can electrically couple the packaged component 100 (FIG. 2) with one or more other components (e.g., a memory device, a processing unit, a power supply) physically separate from the packaged component. In addition to the microphone transducer, one or more other components can be operatively coupled with the interconnect substrate 200. For example, the interconnect substrate can have a region 210 extending away from the microphone package in one or more directions. Within that region 210, the electrical conductors to which the microphone package is electrically coupled can also extend away from the microphone package. Another component (not shown) can electrically couple with the electrical conductors, electrically coupling the microphone package with such other component. Examples of the other component can include a processing unit, a sensor of various types, and/or other functional and/or computational units of a computing environment or other electronic device.

In an embodiment, the interconnect substrate 200 can be a laminated substrate having one or more layers of electrical conductors juxtaposed with alternating layers of dielectric or electrically insulative material, e.g., FR4 or a polyimide substrate. Some interconnect substrates are flexible, e.g., pliable or bendable within certain limits without damage to the electrical conductors or delamination of the juxtaposed layers. The electrical conductors of a flexible circuit board may be formed of an alloy of copper, and the intervening layers separating conductive layers may be formed, for example, from polyimide or another suitable material. Such a flexible circuit board is sometimes referred to in the art as "flex circuit" or "flex." As well, the flex can be perforated or otherwise define one or more through-hole apertures.

As shown in FIG. 7 the microphone package 100 can define a plurality of exposed electrical contacts 108 configured to be soldered or otherwise electrically connected with a corresponding interconnection location 205 defined by the interconnect substrate 200. In an embodiment, the electrical contacts 205 are exposed on a same side of the transducer package 100 as the sound-entry opening 150. In such an embodiment, the interconnect substrate 200 defines an aperture or other gas-permeable region (not shown) configured to permit an acoustic signal to pass therethrough in an acoustically transparent manner, or with a selected measure of damping, acoustically coupling an ambient environment with the sensitive region of the microphone transducer 105 through the interconnect substrate.

Referring still to FIG. 7, the interconnect substrate 200 can define a first major surface 214, an opposed second major surface 217, and an aperture 206 extending through the interconnect substrate from the first major surface to the second major surface. In this embodiment, the package substrate 102 defines a plurality of electrical contacts 108 on a same side of the transducer substrate as the lid 110. Stated differently, the electrical contacts 108 are positioned on a side of the transducer package 100 opposite the sound-entry opening 150. The microphone package 100 can be "inverted" and mounted to the second major surface 217 of the interconnect substrate 200 with the lid 110 of the package extending through the aperture 206 in the electrical substrate. In the arrangement shown in FIG. 7, the interconnect substrate 200 is spaced apart from the sound-entry opening 150 to the sensitive region of the microphone.

VII. Electronic Devices

An electronic device (e.g., a media appliance, a wearable electronic device, a laptop computer, a tablet computer, etc.) can incorporate a microphone assembly 100 or a microphone module 250 described herein. For example, an electronic device can have a chassis having a chassis wall 301, as in FIG. 7. The chassis wall 301 can define an aperture, e.g., a port 302, extending through the wall and acoustically coupling with the sound entry opening 150 into the microphone package 100.

Figure 8:
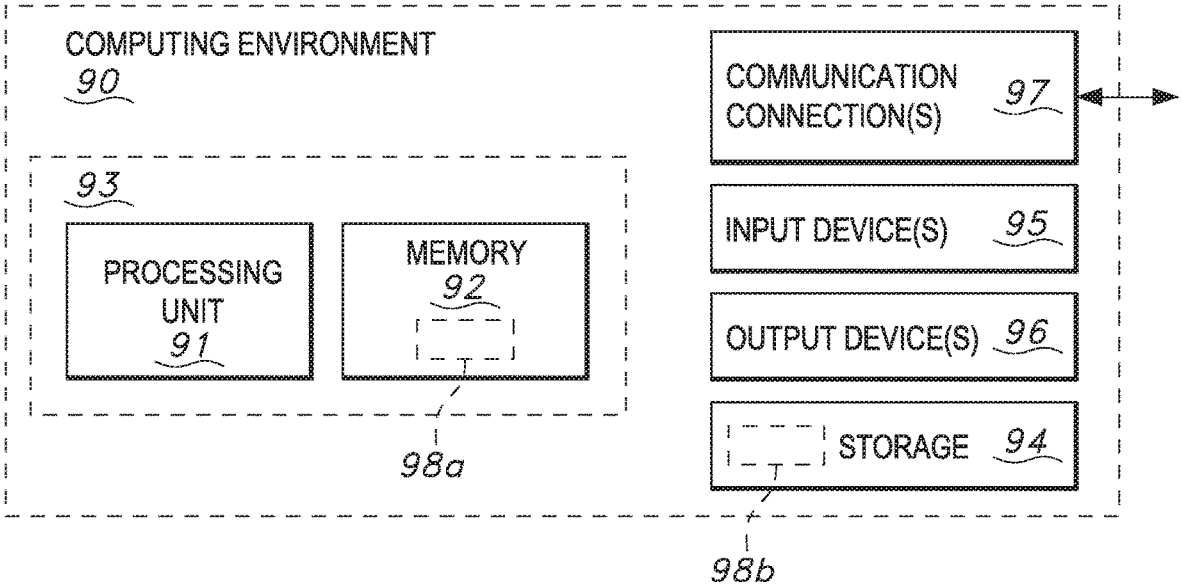
FIG. 8 illustrates a block diagram of a general purpose electronic device that can incorporate a packaged microphone as described herein.

FIG. 8 illustrates a generalized example of a suitable computing environment 90 in which described methods, embodiments, techniques, and technologies relating, for example, to maintaining a temperature of a logic component and/or a power unit below a threshold temperature can be implemented. The computing environment 1700 is not intended to suggest any limitation as to scope of use or functionality of the technologies disclosed herein, as each technology may be implemented in diverse general-purpose or special-purpose computing environments. For example, each disclosed technology may be implemented with other computer system configurations, including wearable and/or handheld devices (e.g., a mobile-communications device, and more particularly but not exclusively, IPHONE®/IPAD®/HomePod™ devices, available from Apple Inc. of Cupertino, Calif.), multiprocessor systems, microprocessor-based or programmable consumer electronics, embedded platforms, network computers, minicomputers, mainframe computers, smartphones, tablet computers, data centers, audio appliances, and the like. Each disclosed technology may also be practiced in distributed computing environments where tasks are performed by remote processing devices that are linked through a communications connection or network. In a distributed computing environment, program modules may be located in both local and remote memory storage devices.

The computing environment 90 includes at least one central processing unit 91 and a memory 92. In FIG. 8, this most basic configuration 93 is included within a dashed line. The central processing unit 91 executes computer-executable instructions and may be a real or a virtual processor. In a multi-processing system, or in a multi-core central processing unit, multiple processing units execute computer-executable instructions (e.g., threads) to increase processing speed and as such, multiple processors can run simultaneously, despite the processing unit 91 being represented by a single functional block. A processing unit can include an application specific integrated circuit (ASIC), a general purpose microprocessor, a field-programmable gate array (FPGA), a digital signal controller, or a set of hardware logic structures arranged to process instructions.

The memory 92 may be volatile memory (e.g., registers, cache, RAM), non-volatile memory (e.g., ROM, EEPROM, flash memory, etc.), or some combination of the two. The memory 92 stores software 98*a* that can, for example, implement one or more of the technologies described herein, when executed by a processor.

A computing environment may have additional features. For example, the computing environment 90 includes storage 94, one or more input devices 95, one or more output devices 96, and one or more communication connections 97. An interconnection mechanism (not shown) such as a bus, a controller, or a network, interconnects the components of the computing environment 90. Typically, operating system software (not shown) provides an operating environment for other software executing in the computing environment 90, and coordinates activities of the components of the computing environment 90.

The store 94 may be removable or non-removable, and can include selected forms of machine-readable media. In general machine-readable media includes magnetic disks, magnetic tapes or cassettes, non-volatile solid-state memory, CD-ROMs, CD-RWs, DVDs, magnetic tape, optical data storage devices, and carrier waves, or any other machine-readable medium which can be used to store information and which can be accessed within the computing environment 90. The storage 94 can store instructions for the software 98*b*, which can implement technologies described herein.

The store 94 can also be distributed over a network so that software instructions are stored and executed in a distributed fashion. In other embodiments, some of these operations might be performed by specific hardware components that contain hardwired logic. Those operations might alternatively be performed by any combination of programmed data processing components and fixed hardwired circuit components.

The input device(s) 95 may be any one or more of the following: a touch input device, such as a keyboard, keypad, mouse, pen, touchscreen, touch pad, or trackball; a voice input device, such as a microphone transducer, speech-recognition software and processors; a scanning device; or another device, that provides input to the computing environment 90. For audio, the input device(s) 95 may include a microphone or other transducer (e.g., a sound card or similar device that accepts audio input in analog or digital form), or a computer-readable media reader that provides audio samples to the computing environment 90.

The output device(s) 96 may be any one or more of a display, printer, loudspeaker transducer, DVD-writer, or another device that provides output from the computing environment 90.

The communication connection(s) 97 enable communication over or through a communication medium (e.g., a connecting network) to another computing entity. A communication connection can include a transmitter and a receiver suitable for communicating over a local area network (LAN), a wide area network (WAN) connection, or both. LAN and WAN connections can be facilitated by a wired connection or a wireless connection. If a LAN or a WAN connection is wireless, the communication connection can include one or more antennas or antenna arrays. The communication medium conveys information such as computer-executable instructions, compressed graphics information, processed signal information (including processed audio signals), or other data in a modulated data signal. Examples of communication media for so-called wired connections include fiber-optic cables and copper wires. Communication media for wireless communications can include electromagnetic radiation within one or more selected frequency bands.

As noted above, the input device(s) 95 may include a microphone packaged as described herein. In an embodiment, the microphone package has a package substrate, a microphone transducer, and a processing device coupled with the microphone transducer and the package substrate. A lid defines a chamber at least partially enclosing the microphone transducer and the processing device. An interconnect bus can operatively couple the processing device with the processor and the memory of the electronic device. The lid of the microphone package can include a patterned conductor configured to inhibit formation of eddy currents within the patterned conductor when the patterned conductor is exposed to electromagnetic radiation. The lid can include a molded and electrically insulative member coupled with the patterned conductor. The interconnect bus can have a ground connection. The package substrate can include a ground plane electrically coupled with the ground connection. The patterned conductor can be electrically coupled with the ground plane, electrically coupling the patterned conductor with the ground connection of the interconnect bus.

Machine-readable media are any available media that can be accessed within a computing environment 90. By way of example, and not limitation, with the computing environment 90, machine-readable media include memory 92, storage 94, communication media (not shown), and combinations of any of the above. Tangible machine-readable (or computer-readable) media exclude transitory signals.

As explained above, some disclosed principles can be embodied in a tangible, non-transitory machine-readable medium (such as microelectronic memory) having stored thereon instructions. The instructions can program one or more data processing components (generically referred to here as a "processor") to perform a processing operations described above, including estimating, computing, calculating, measuring, adjusting, sensing, measuring, filtering, addition, subtraction, inversion, comparisons, and decision making (such as by the control unit 52). In other embodiments, some of these operations (of a machine process) might be performed by specific electronic hardware components that contain hardwired logic (e.g., dedicated digital filter blocks). Those operations might alternatively be performed by any combination of programmed data processing components and fixed hardwired circuit components.

VIII. Other Embodiments

The previous description is provided to enable a person skilled in the art to make or use the disclosed principles. Embodiments other than those described above in detail are contemplated based on the principles disclosed herein, together with any attendant changes in configurations of the respective apparatus or changes in order of method acts described herein, without departing from the spirit or scope of this disclosure. Various modifications to the examples described herein will be readily apparent to those skilled in the art.

Directions and other relative references (e.g., up, down, top, bottom, left, right, rearward, forward, etc.) may be used to facilitate discussion of the drawings and principles herein, but are not intended to be limiting. For example, certain terms may be used such as "up," "down,", "upper," "lower," "horizontal," "vertical," "left," "right," and the like. Such terms are used, where applicable, to provide some clarity of description when dealing with relative relationships, particularly with respect to the illustrated embodiments. Such terms are not, however, intended to imply absolute relationships, positions, and/or orientations. For example, with respect to an object, an "upper" surface can become a "lower" surface simply by turning the object over. Nevertheless, it is still the same surface and the object remains the same. As used herein, "and/or" means "and" or "or", as well as "and" and "or." Moreover, all patent and non-patent literature cited herein is hereby incorporated by reference in its entirety for all purposes.

And, those of ordinary skill in the art will appreciate that the exemplary embodiments disclosed herein can be adapted to various configurations and/or uses without departing from the disclosed principles. Applying the principles disclosed herein, it is possible to provide a wide variety of arrangements for high-aspect ratio, barometric vents to reduce leakage noise. For example, the principles described above in connection with any particular example can be combined with the principles described in connection with another example described herein. Thus, all structural and functional equivalents to the features and method acts of the various embodiments described throughout the disclosure that are known or later come to be known to those of ordinary skill in the art are intended to be encompassed by the principles described and the features and acts claimed herein. Accordingly, neither the claims nor this detailed description shall be construed in a limiting sense, and following a review of this disclosure, those of ordinary skill in the art will appreciate the wide variety of acoustic vents that can be devised using the various concepts described herein.

Moreover, nothing disclosed herein is intended to be dedicated to the public regardless of whether such disclosure is explicitly recited in the claims. No claim feature is to be construed under the provisions of 35 USC 112(f), unless the feature is expressly recited using the phrase "means for" or "step for".

The appended claims are not intended to be limited to the embodiments shown herein, but are to be accorded the full scope consistent with the language of the claims, wherein reference to a feature in the singular, such as by use of the article "a" or "an" is not intended to mean "one and only one" unless specifically so stated, but rather "one or more". Further, in view of the many possible embodiments to which the disclosed principles can be applied, we reserve the right to claim any and all combinations of features and technologies described herein as understood by a person of ordinary skill in the art, including the right to claim, for example, all that comes within the scope and spirit of the foregoing description, as well as the combinations recited, literally and equivalently, in any claims presented anytime throughout prosecution of this application or any application claiming benefit of or priority from this application, and more particularly but not exclusively in the claims appended hereto.

We currently claim:

1. A microphone package comprising:

an interconnect substrate;

a microphone transducer coupled with the substrate; and a lid overlying the microphone transducer, wherein at least a portion of the lid is spaced from the substrate, defining an acoustic chamber for the microphone transducer, wherein the lid comprises a stratum of conductive material having anisotropic conductivity, wherein the stratum of conductive material comprises a plurality of discrete members, wherein each respective member is electrically coupled with at least one corresponding electrical connection, and wherein each discrete member is electrically isolated from each other discrete member.

2. The microphone package according to claim 1, wherein the lid comprises a non-conductive substrate and wherein the stratum of conductive material comprises a conformal coating overlying the non-conductive substrate.

3. The microphone package according to claim 1, wherein the at least one corresponding electrical connection comprises a common ground pad, wherein each discrete member is electrically coupled with the common ground pad.

4. The microphone package according to claim 1, wherein the stratum of conductive material comprises a unitary construct defining a plurality of apertures.

5. The microphone package according to claim 4, wherein the lid comprises a non-conductive substrate defining a protrusion extending through at least one of the apertures.

6. The microphone package according to claim 1, wherein the interconnect substrate defines a ground plane, wherein the stratum of conductive material is electrically coupled with the ground plane, defining a Faraday cage around the acoustic chamber.

7. A microphone module, comprising:

an interconnect substrate having a plurality of electrical conductors; and a microphone package having a package substrate, a microphone transducer and a processing device coupled with the package substrate, and a lid defining a chamber at least partially enclosing the microphone transducer and the processing device, wherein the chamber is bounded in part by the package substrate, wherein the package substrate electrically couples the microphone transducer, the processing device, or both, with at least one of the plurality of electrical conductors of the interconnect substrate, wherein the lid comprises a patterned conductor, wherein the patterned conductor is non-continuous in at least one direction, and wherein the lid further comprises a molded and electrically insulative member defining a boss, and wherein the patterned conductor defines an aperture positioned in correspondence to the boss.

8. The microphone module according to claim 7, wherein the molded and electrically insulative member is coupled with the patterned conductor.

9. The microphone module according to claim 8, wherein the patterned conductor comprises one or more of a metal mesh, a stamped metal plate and a metal plating.

10. The microphone module according to claim 7, wherein the patterned conductor comprises a plurality of electrically conductive members.

11. The microphone module according to claim 7, wherein the aperture is so positioned in the patterned conductor as to inhibit formation of eddy currents within the patterned conductor when the patterned conductor is exposed to electromagnetic radiation.

12. The microphone module according to claim 7, wherein the patterned conductor comprises an electrically conductive member defining a plurality of apertures so arranged as to inhibit formation of eddy currents within the electrically conductive member when the electrically conductive member is exposed to electromagnetic radiation.

13. The microphone module according to claim 7, wherein the package substrate comprises a ground plane and the patterned conductor is electrically coupled with the ground plane.

14. A microphone module, comprising:

an interconnect substrate having a plurality of electrical conductors; and a microphone package having a package substrate, a microphone transducer and a processing device coupled with the package substrate, and a lid defining a chamber at least partially enclosing the microphone transducer and the processing device, wherein the chamber is bounded in part by the package substrate, wherein the package substrate electrically couples the microphone transducer, the processing device, or both, with at least one of the plurality of electrical conductors of the interconnect substrate, wherein the lid comprises a patterned conductor, wherein the patterned conductor is non-continuous in at least one direction, wherein the package substrate comprises a ground plane and the patterned conductor is electrically coupled with the ground plane, wherein the patterned conductor comprises a plurality of electrically conductive members, and wherein each electrically conductive member is electrically coupled with the ground plane independently of each other electrically conductive member.

15. An electronic device, comprising:

a processor, a memory, and an interconnect bus; and a microphone package having a package substrate, a microphone transducer, a processing device coupled with microphone transducer and the package substrate, and a lid defining a chamber at least partially enclosing the microphone transducer and the processing device, wherein the interconnect bus operatively couples the processing device with the processor and the memory;

wherein the lid comprises a patterned conductor having anisotropic conductivity, wherein the patterned conductor comprises a plurality of discrete members, wherein each respective member is electrically coupled with at least one corresponding electrical connection, and wherein each discrete member is electrically isolated from each other discrete member.

16. The electronic device according to claim 15, wherein the lid further comprises a molded and electrically non-conductive member coupled with the patterned conductor.

17. The electronic device according to claim 15, wherein the interconnect bus comprises a ground connection, wherein the package substrate comprises a ground plane electrically coupled with the ground connection, and wherein the patterned conductor is electrically coupled with the ground plane, electrically coupling the patterned conductor with the ground connection of the interconnect bus.

* * * * *